US009462906B2

(12) United States Patent
Avison et al.

(10) Patent No.: US 9,462,906 B2
(45) Date of Patent: Oct. 11, 2016

(54) BRA STORAGE DEVICE

(75) Inventors: Emma Avison, Leederville (AU); Edward Joseph Khoury, Bateman (AU)

(73) Assignee: Emma Avison, Tuart Hill, Western Australia (AU)

( * ) Notice: Subject to any disclaimer, the term of this patent is extended or adjusted under 35 U.S.C. 154(b) by 699 days.

(21) Appl. No.: 13/884,608

(22) PCT Filed: Nov. 11, 2011

(86) PCT No.: PCT/AU2011/001453

§ 371 (c)(1),
(2), (4) Date: May 24, 2013

(87) PCT Pub. No.: WO2012/061892

PCT Pub. Date: May 18, 2012

(65) Prior Publication Data

US 2013/0334265 A1 Dec. 19, 2013

(30) Foreign Application Priority Data

Nov. 12, 2010 (AU) ..... 2010905017

(51) Int. Cl.

| | |
|---|---|
| ***A47G 25/00*** | (2006.01) |
| ***A47F 7/19*** | (2006.01) |
| ***A47G 25/18*** | (2006.01) |
| ***B65D 85/18*** | (2006.01) |
| *A47G 25/14* | (2006.01) |

(52) U.S. Cl.

CPC ..... *A47G 25/00* (2013.01); *A47F 7/19* (2013.01); *A47G 25/18* (2013.01); *A47G 25/183* (2013.01); *B65D 85/18* (2013.01); *A47G 2025/1492* (2013.01)

(58) Field of Classification Search

CPC ..... A45C 13/03; B65D 85/18; A47G 25/00; A47G 25/18; A47G 25/183; A47F 7/19

See application file for complete search history.

(56) References Cited

U.S. PATENT DOCUMENTS

| | | | | |
|---|---|---|---|---|
| 3,837,476 | A * | 9/1974 | Schwartz | B65D 85/18 206/278 |
| 7,516,840 | B2 * | 4/2009 | Troha | A45C 13/03 206/278 |
| 2009/0266851 | A1 * | 10/2009 | Perlman | B65D 85/18 223/84 |
| 2011/0186454 | A1 * | 8/2011 | Crumpton | B65D 85/18 206/292 |
| 2012/0292209 | A1 * | 11/2012 | Willey | A47G 25/14 206/279 |
| 2014/0144952 | A1 * | 5/2014 | Prado | A47G 25/18 223/120 |

FOREIGN PATENT DOCUMENTS

| | | | |
|---|---|---|---|
| JP | 08332123 | A * | 12/1996 |
| JP | 2003237865 | * | 8/2003 |

* cited by examiner

*Primary Examiner* — Shaun R Hurley
*Assistant Examiner* — Andrew W Sutton
(74) *Attorney, Agent, or Firm* — Tope-McKay & Associates

(57) ABSTRACT

Described is a bra storage device having a plurality of storage modules. Each storage module includes a base wall provided with bra support members onto which the cups of a bra can be placed. One or more side walls are provided extending from the base wall. First connectors are provided on edges of the side walls remote from the base wall and second connectors are provided on edges of the side walls adjacent the base wall such that the first connectors of the storage module are connectable to the second connectors of an adjacent storage module.

10 Claims, 19 Drawing Sheets

BRA STORAGE DEVICE

BACKGROUND OF THE INVENTION (1) Field of Invention

The present invention relates to a device used for storing bras and, more particularly, to a device used for storing bras that prevents damage to the bras.

(2) Description of Related Art

It is common for women to own a number of bras. Generally, the bras are simply stored in a drawer along with other items of clothing. Such storage can often result in damage in the form of deformation of the cup of the bra due to it being compressed between other items of clothing. Due to the fact that some bras can be relatively expensive, such damage is obviously undesirable.

The present invention relates to a bra storage device aimed at storing multiple bras in a manner that both prevents damage to the bras and allows easy access to both view and remove the stored bras.

SUMMARY OF THE INVENTION

The present invention relates to a device used for storing bras and, more particularly, to a device used for storing bras that prevents damage to the bras. The bra storage device comprises a plurality of storage modules. Each storage module comprises a base wall provided with a bra support member onto which the cups of a bra can be placed; at least one side wall extending from the base wall, wherein the at least one side wall has edges remote from the base wall and adjacent the base wall; at least one first connector provided on edges of the side walls remote from the base wall; and at least one second connector provided on edges of the side walls adjacent the base wall. The first connectors of the storage module are connectable to the second connectors of an adjacent storage module.

In another aspect, the base wall comprises a planar member, and each bra support member comprises a pair of domed members extending outwardly from the base wall.

In another aspect, the pair of domed members are integrally formed with the base wall such that each domed member comprises a domed portion of the base wall extending outwardly therefrom.

In another aspect, the base wall is rectangular and comprises first and second parallel sides and first and second parallel ends, and the at least one side wall comprises first and second side walls extending transversely from the first and second ends of the base wall and a third side wall extending transversely from the first side of the base wall between the first and second end walls.

In another aspect, the storage modules are connectable such that the third side wall of each storage module is coplanar, and the base wall of each storage module is parallel to the base wall of an adjacent storage module, such that a compartment is defined between the base wall, the side walls, and the base wall of the adjacent storage module into which a bra may be placed.

In another aspect, the first connectors comprise ribs extending along the edges of the first and second side walls, and the second connectors comprise channels extending along opposite edges of the first and second side walls, such that the ribs of a storage module are receivable in the channels of an adjacent storage module.

In another aspect, the first connectors comprise a plurality of lugs on the edge of the third side wall remote from the base wall, and the second connectors comprise corresponding slots in the edge of the third side all adjacent the base wall, such that the lugs are received in the slots to connect multiple storage modules together.

In another aspect, the third side wall is pivotally connected to the base wall, such that the base wall can be pivoted between a position in which the base wall is parallel to the side wall and a position in which the base wall is generally perpendicular to the side wall.

In another aspect, the first and second side walls comprise protrusions provided to engage in recesses in edges of the third side wall when the base wall is pivoted such that the first and second side walls are adjacent the third side wall.

In another aspect, the protrusions engage in the recesses in a snap-lit manner.

Additionally, the present invention relates to a bra storage module comprising a base wall; and a plurality of bra support members secured above the base wall, such that at least one bra support member can be pivoted between a first position in which the bra support member is oriented above and generally parallel to the base wall and a second position in which the bra support member is generally perpendicular to the base wall.

In another aspect, each bra support member comprises a pair of domed members joined by an interconnecting portion provided with a connecting member pivotally securable to either the base wall or the connecting member of a bra support member located below.

In another aspect, the base wall is provided with a connector base having a protrusion on a distal end thereof, and each connecting member comprises an opening for receiving the protrusion, wherein the protrusion comprises a pair of lugs on opposite sides thereof received in recesses on opposed inner surfaces of the opening.

In another aspect, each connector comprises a protrusion having a pair of lugs thereon to be received in an opening of a further bra support member.

In another aspect, the pair of domed members of the bra support members each comprises a recessed lower side such that the pair of domed members of each bra support member are received in the recessed lower sides of the bra support members above.

In another aspect, the base wall comprises a planar member having first and second parallel sides and first and second parallel ends, and wherein a pair of arms is connectable to the base wall adjacent to the first and second ends, wherein the pair of arms comprises hooks at ends thereof for hanging the bra storage member.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a device used for storing bras and, more particularly, to a device used for storing bras that prevents damage to the bras. The following description is presented to enable one of ordinary skill in the art to make and use the invention and to incorporate it in the context of particular applications. Various modifications, as well as a variety of uses, in different applications will be readily apparent to those skilled in the art, and the general principles defined herein may be applied to a wide range of embodiments. Thus, the present invention is not intended to be limited to the embodiments presented, but is to be accorded with the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing, a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object. As such, as the present invention is changed, the above labels may change their orientation.

(1) Specific Details

Figure 1:
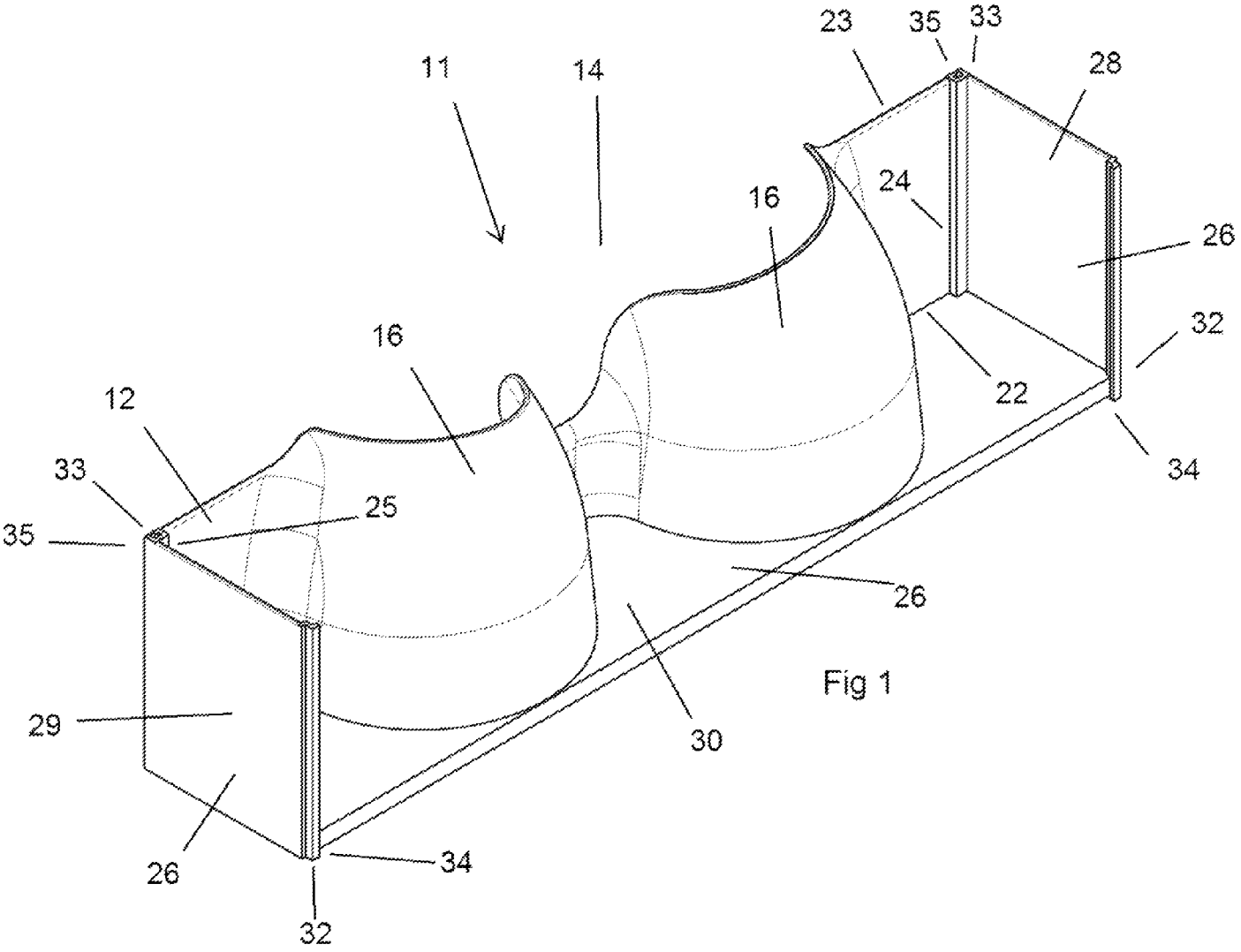
FIG. 1 is a top, perspective-view illustration of an embodiment of a storage module of a bra storage device according to principles of the present invention.
Figure 2:
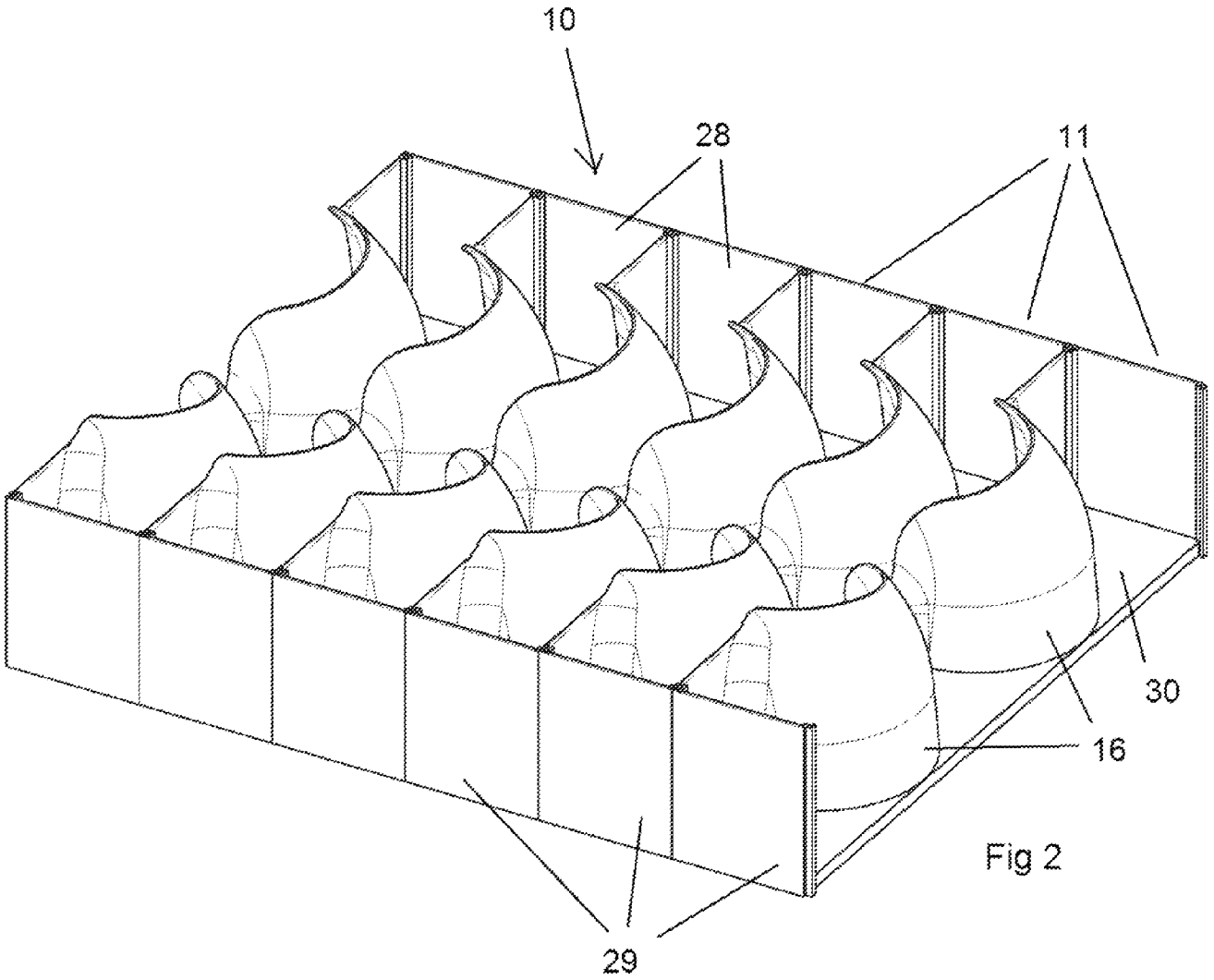
FIG. 2 is a top, perspective-view illustration of a plurality of storage modules connected to form the bra storage device according to principles of the present invention.
Figure 3:
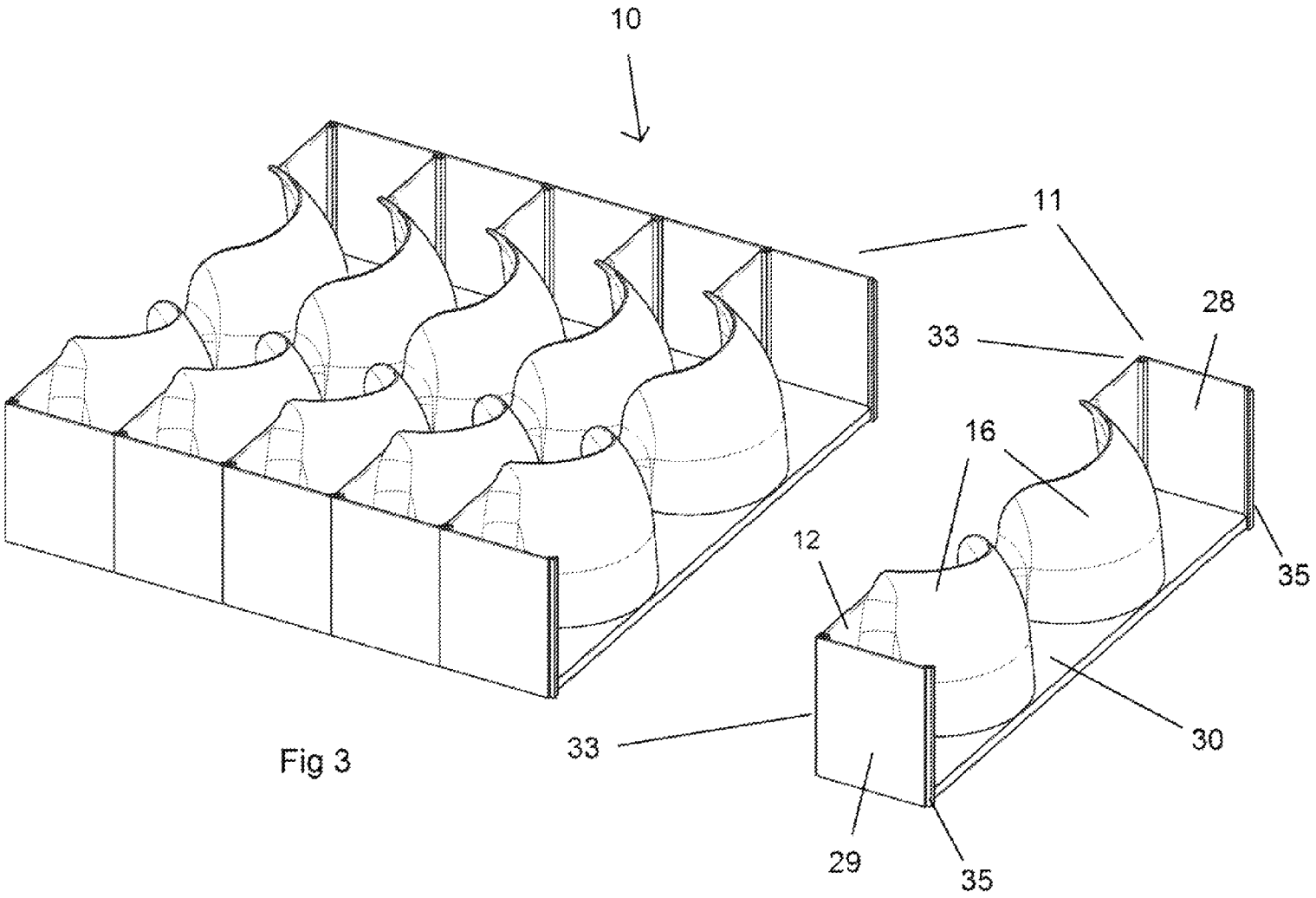
FIG. 3 is a top, perspective-view illustration of an end-most storage module disconnected from a plurality of storage modules according to principles of the present invention.

FIG. 1 illustrates a single storage module 11 in accordance with the present invention. FIGS. 2-6 illustrate a bra storage device 10 comprising a plurality of storage modules 11. Each storage module 11 is provided for supporting a single bra 20 (shown in FIGS. 5 and 6). Each of the storage modules 11 comprises a base wall 12 on which is provided a bra support member 14. The base wall 12 is planar in shape, and each bra support member 14 comprises a pair of domed members 16 extending outwardly from the base wall 12. The domed members 16 are arranged such that the cups of the bra 20 can be placed on the domed members 16. The domed members 16 are shaped to support the cups of the bra 20 to prevent damage to the bra 20.

The base wall 12 is generally rectangular in shape and the domed members 16 are integrally formed with the base wall 12 such that each domed member 16 comprises a domed portion of the base wall 12 extending outwardly therefrom. The base wall 12 includes first and second parallel sides 22 and 23 and first and second parallel ends 24 and 25. The domed members 16 are arranged such that a first of the domed members 16 is located, between a midpoint of the base wall 12 and the first end 22 of the base wall 12, and a second of the domed members 16 is located between the midpoint of the base wall 12 and the second end 24 of the base wall 12.

Figure 4:
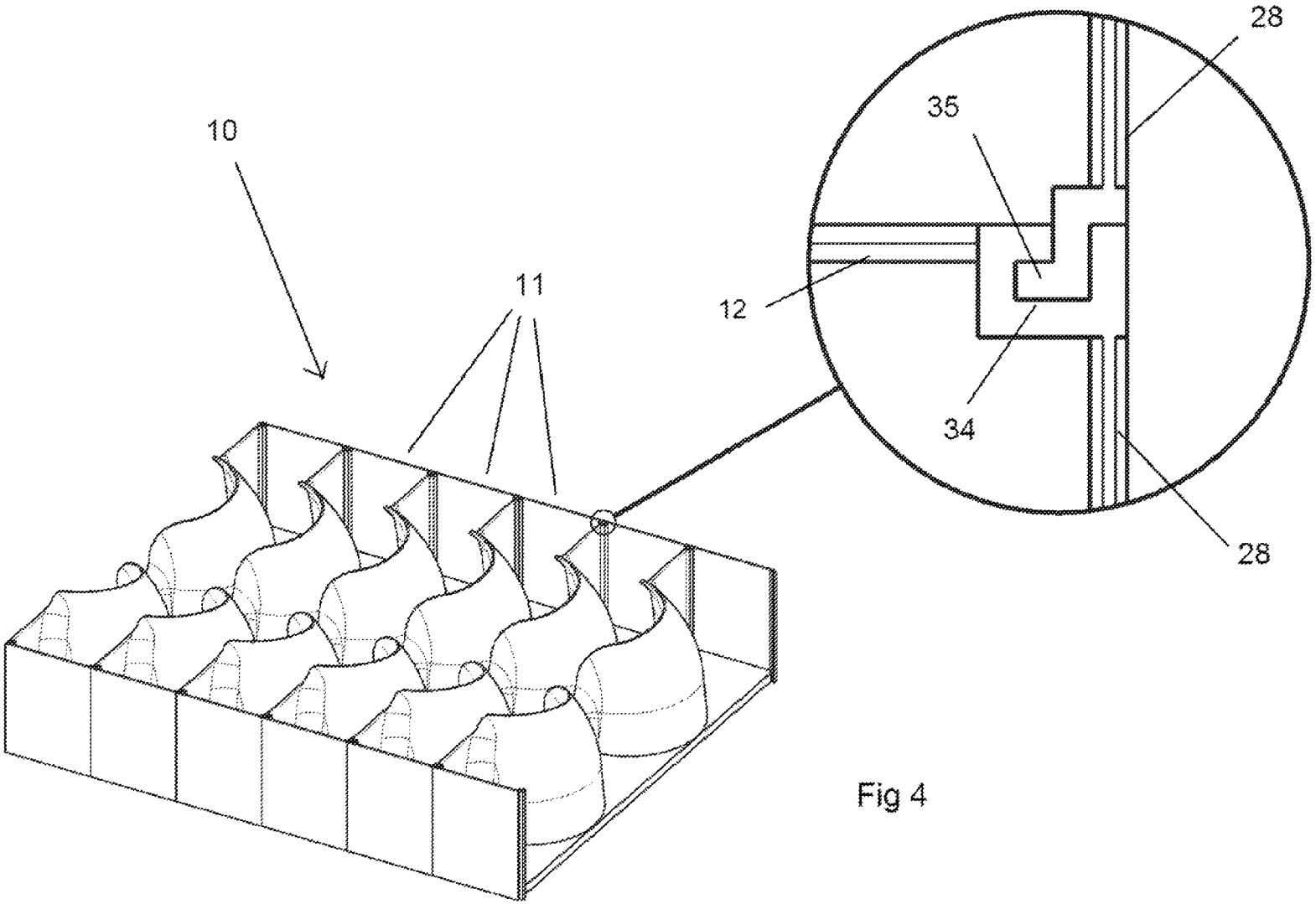
FIG. 4 is an enlarged-view illustration of the connection between adjacent storage modules according to principles of the present invention.
Figure 5:
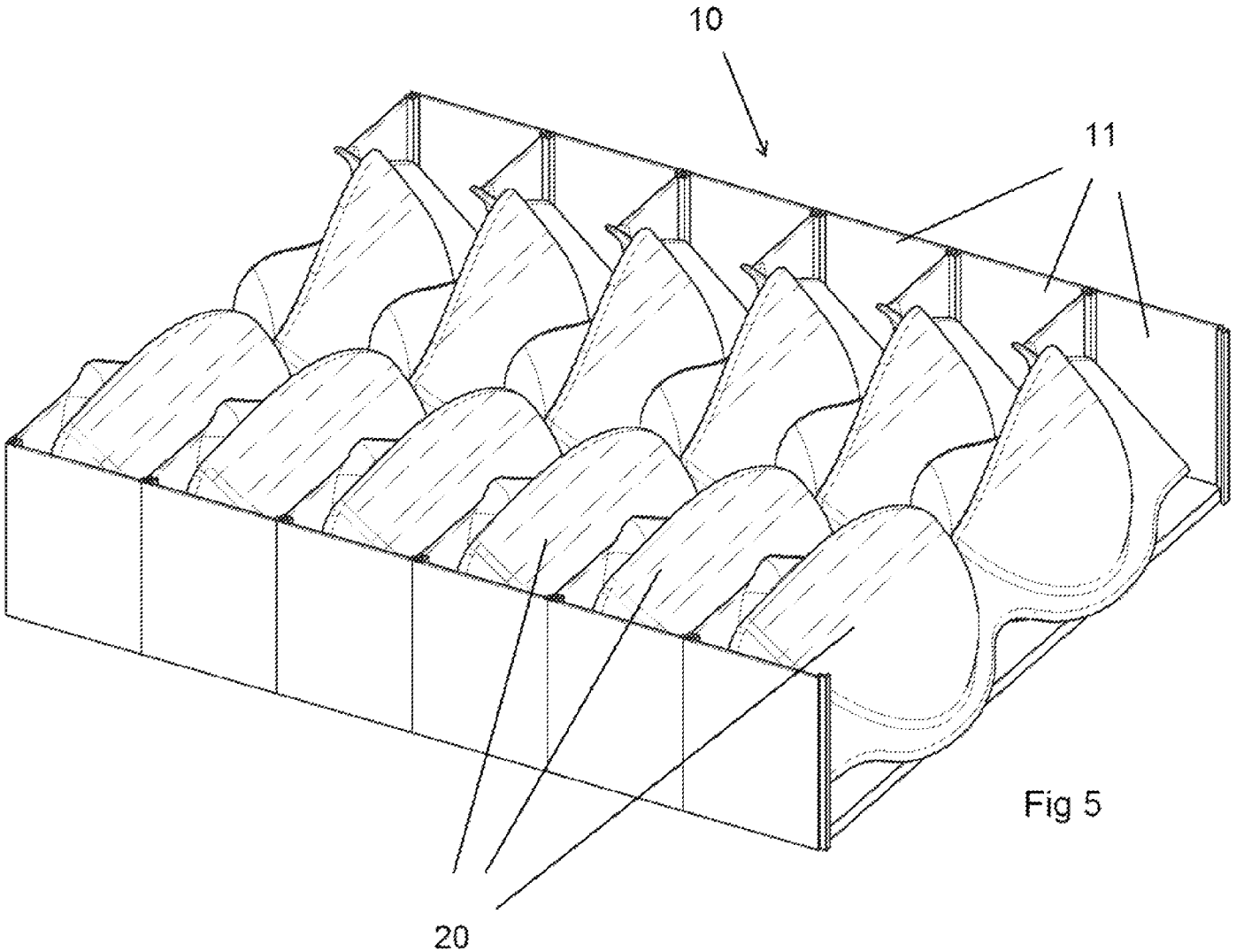
FIG. 5 is a top, perspective-view illustration of the bra storage device shown receiving bras according to principles of the present invention.
Figure 6:
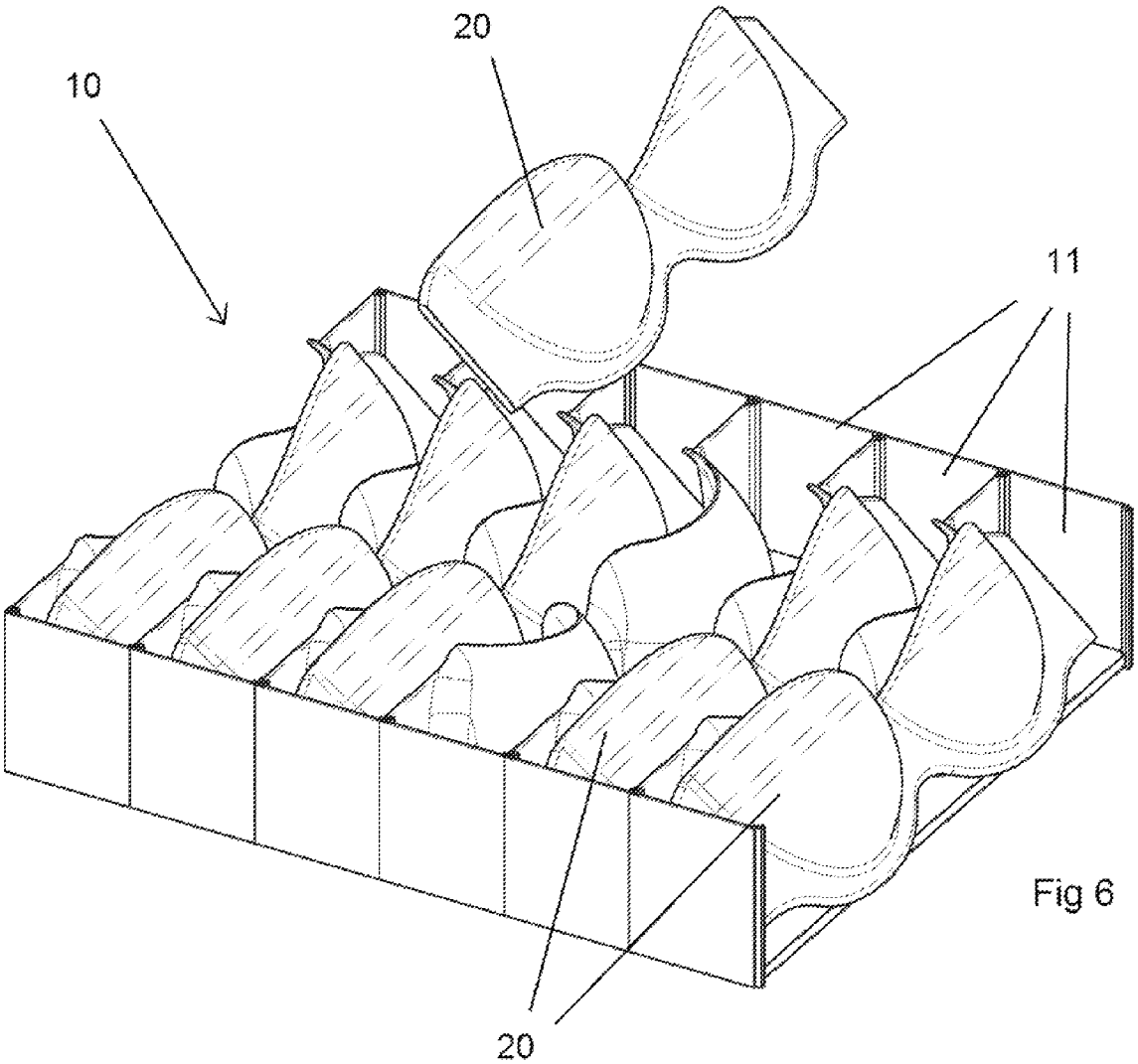
FIG. 6 is a top, perspective-view illustration of the bra storage device showing removal of a bra according to principles of the present invention.
Figure 7:
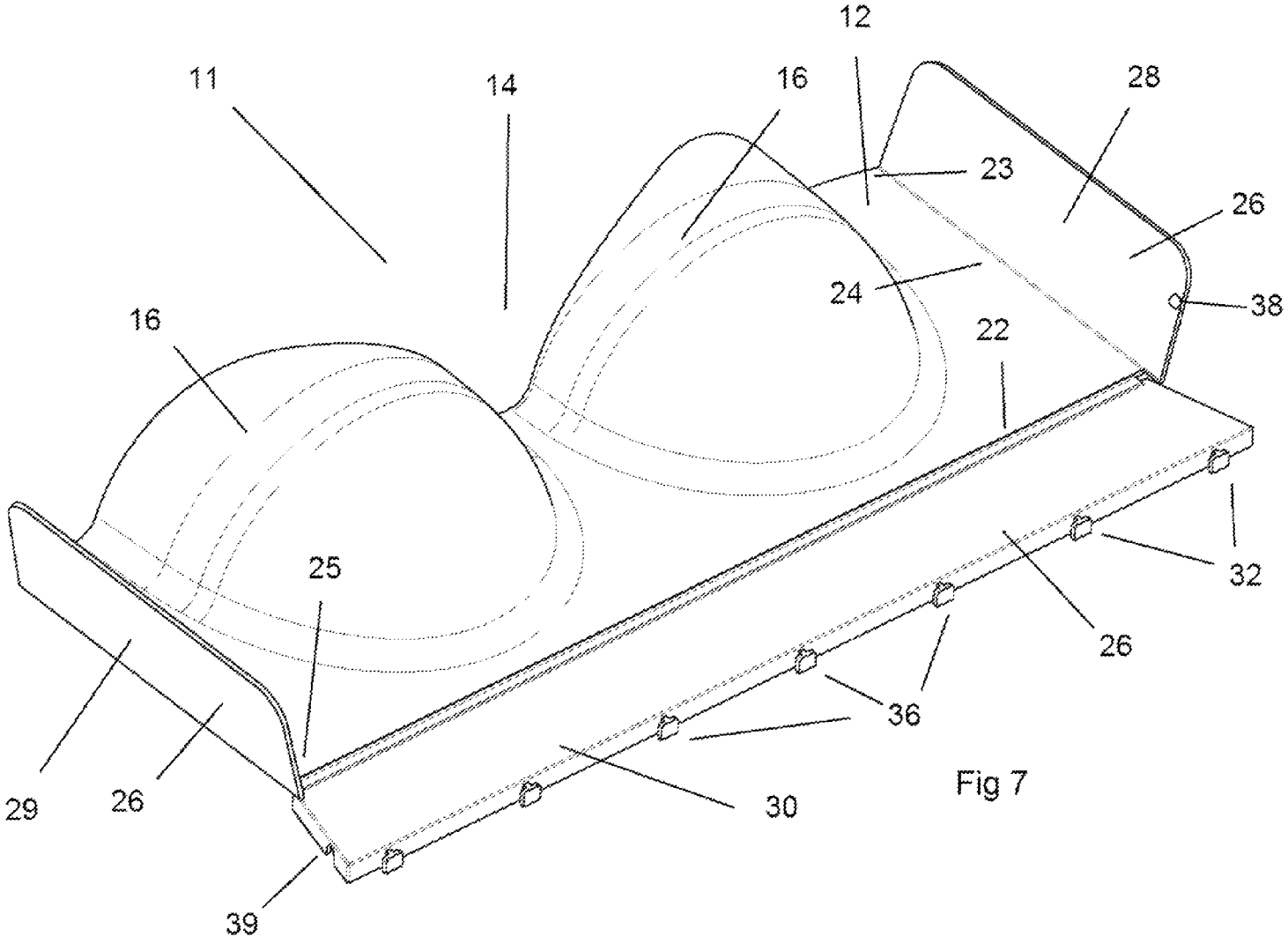
FIG. 7 is a top, perspective-view illustration of an embodiment of a storage module of a bra storage device according to principles of the present invention.
Figure 8B:
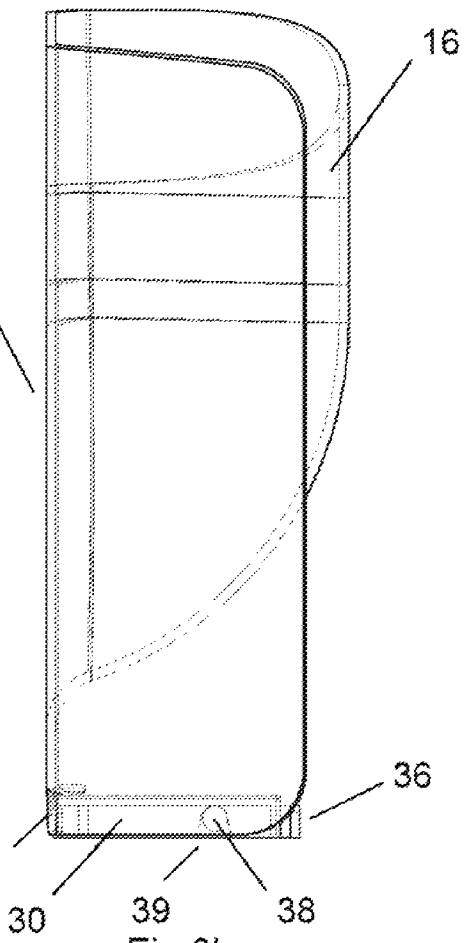
FIG. 8*b* is a side-view illustration of the storage module of FIG. 7 with the base wall in a vertical position according to principles of the present invention.
Figure 8A:
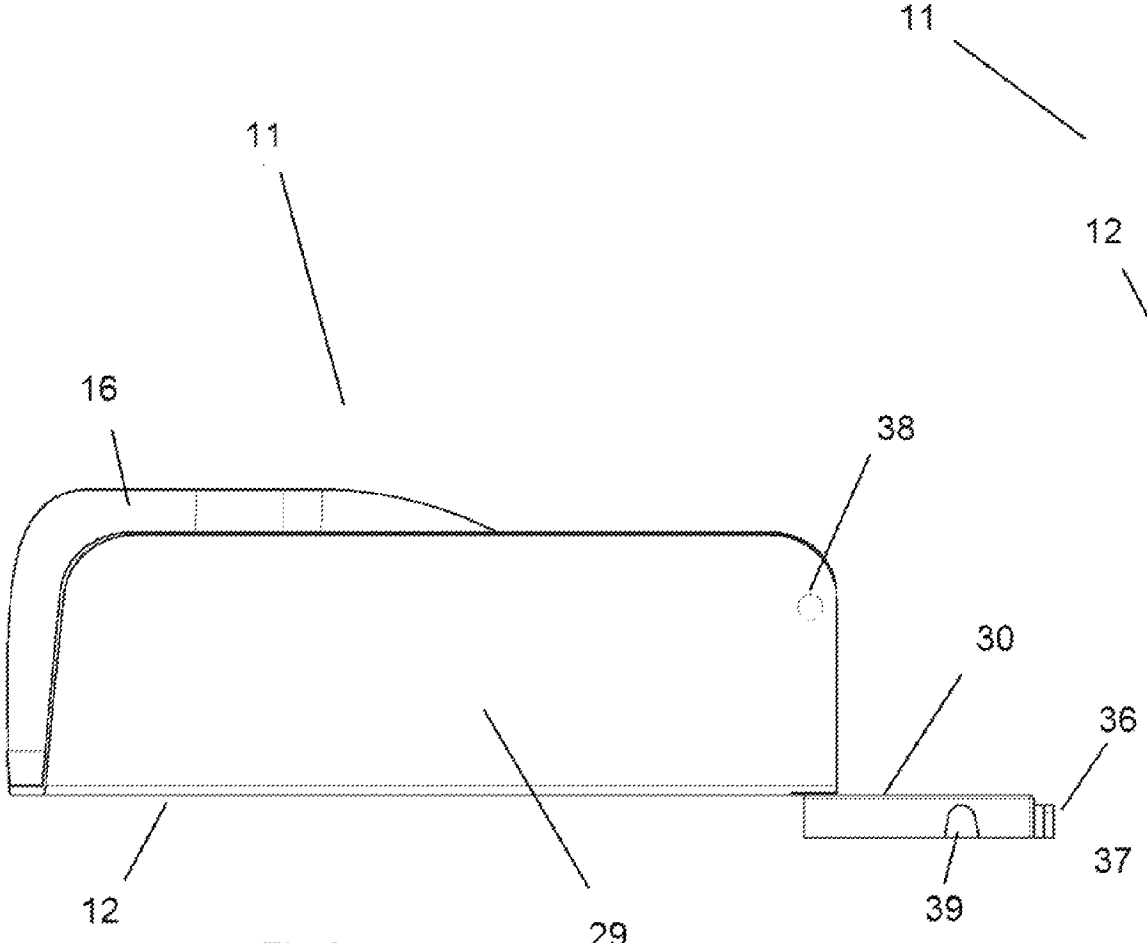
FIG. 8*a* is a side-view illustration of the storage module of FIG. 7 with the base wall in a horizontal position according to principles of the present invention.
Figure 9:
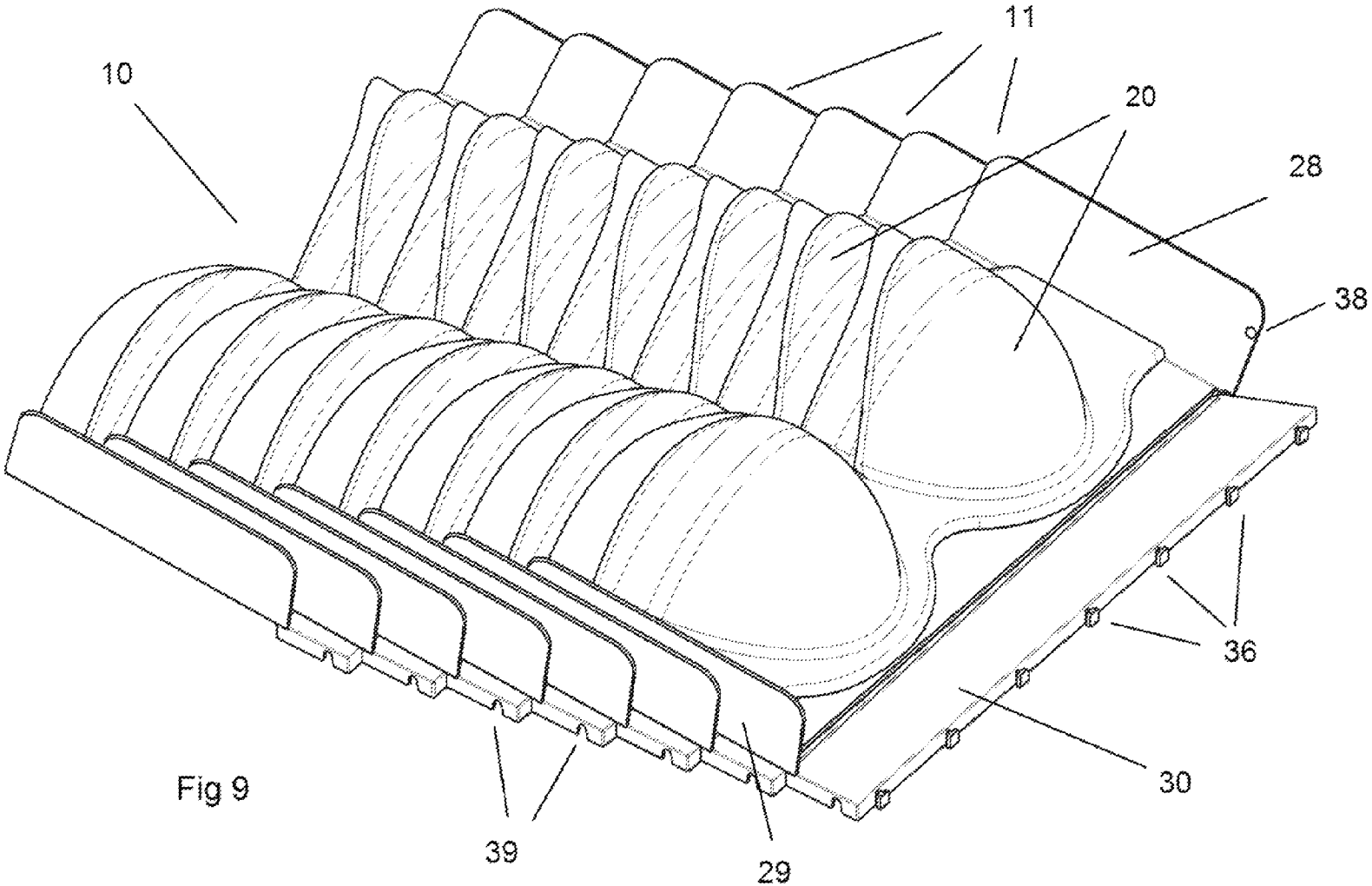
FIG. 9 is a top, perspective-view illustration of a bra storage device formed from a plurality of the storage modules of FIG. 7 with the base walls in the horizontal positions according to principles of the present invention.
Figure 10:
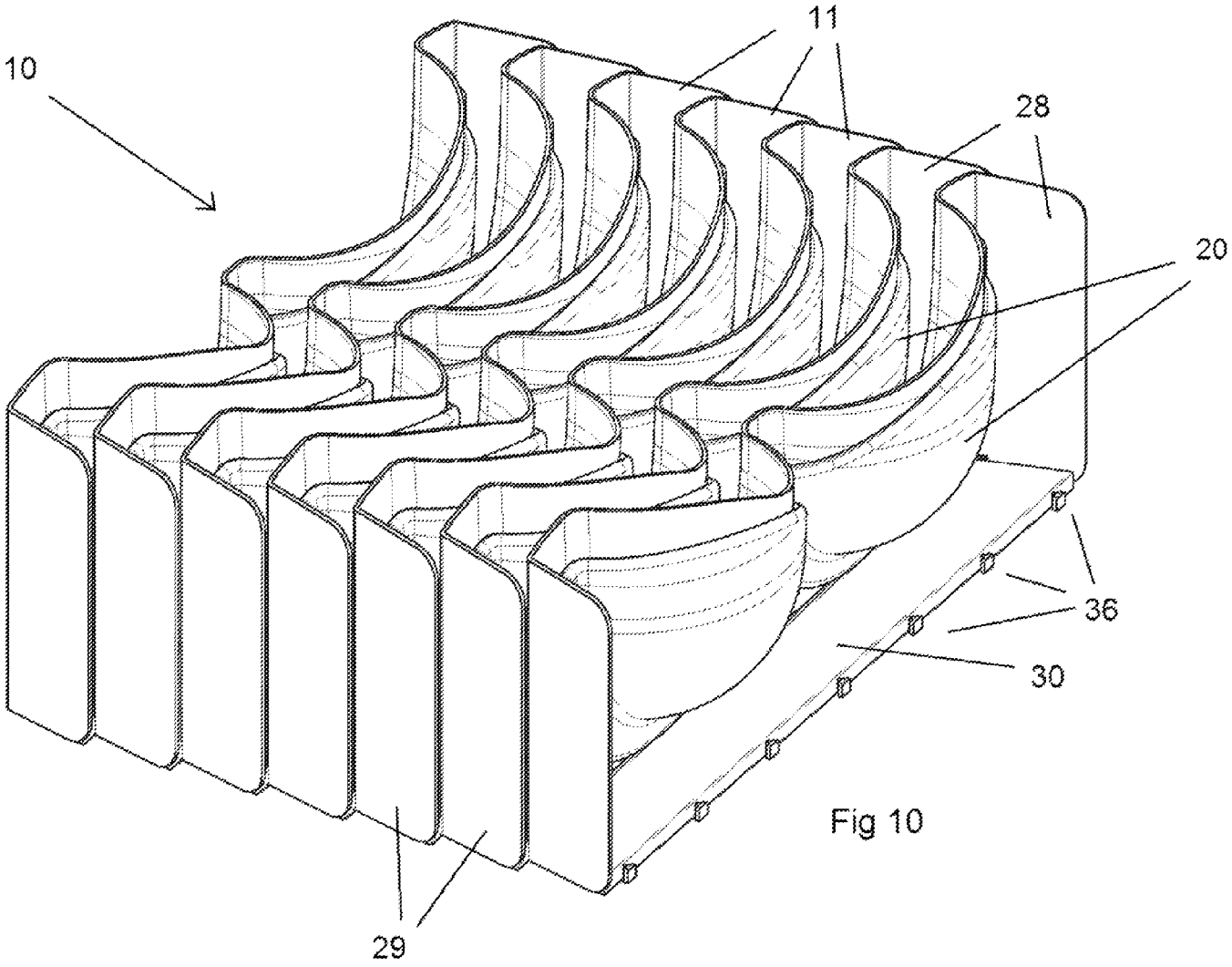
FIG. 10 is a top, perspective-view illustration of the bra storage device formed from a plurality of the storage modules of FIG. 7 with the base walls in the vertical positions according to principles of the present invention.

The bra storage device 10 of FIGS. 1-6 comprises a plurality of side walls 26 extending from the base wall 12. A first side wall 28 extends transversely from the first end 24 of the base wall 12, and a second end wall 29 extends transversely from the second end 25 of the base wall 12. A third side wall 30 extends transversely from the first side 22 of the base wall 12 between the first and second side walls 28 and 29. In use, the storage module 11 can be placed on a horizontal surface resting on the third side wall 30. A bra 20 can be placed into the storage module 11 such that the cups of the bra 20 rest on the domed members 16, as shown in FIGS. 5 and 6.

A plurality of storage modules 11 is connectable together to form the bra storage device 10 for storing multiple bras 20. Connectors are provided on edges of the side walls in order to connect the side walls to side walls of an adjacent storage module 11. The side walls are provided with first connectors 32 on edges remote from the base wall 12 and second connectors 33 on edges adjacent the base wall 12. The first connectors 32 of a storage module 11 connect to the second connectors 33 on an adjacent storage module 11.

In the embodiment shown in FIG. 1, the second connectors 33 comprise channels 35 extending along the lengths of the edges of first and second side walls 28 and 29. The first connectors 32 comprise ribs 34 extending along the edges of the first and second side walls 28 and 29 remote from the channels 35.

As shown in FIG. 4, the ribs 34 can be slid into the channels 35 of an adjacent storage module 11 in order to connect to the storage modules 11 together. A suitable number of storage modules 11 can be interconnected to form a unit for storing multiple bras 20 that can be placed, for example, in a drawer. When connected, the third side walls 30 of each of the storage modules 11 are coplanar and the base walls 12 are all parallel. Each storage module 11 defines a compartment between the base wall 12, the side walls 26, and the base wall 12 of the adjacent storage module 11 into which a bra 20 may be placed.

FIGS. 7-12 illustrate a second embodiment of a bra storage device 10 in accordance with the present invention. The second embodiment is similar to the first embodiment and like reference numerals are used to denote like parts.

The third side wall 30 in the embodiment of FIGS. 7-12 is pivotally connected to the first side 22 of the base wall 12. When the third side wall 30 is placed on a surface, the base wall 12 and first and second side walls 28 and 29 can, therefore, be pivoted between a position in which the base wall 12 is parallel to the third side wall 30 and a position in which the base wall 12 is generally perpendicular to the third side wall 30. That is the base wall 12 can be pivoted between horizontal and vertical positions when the third side wall 30 is placed on a horizontal surface.

The first and second side walls 28 and 29 also include protrusions 38 provided to engage in recesses 39 in edges of the third side wall 30 when the base wall 12 is pivoted such that the first and second side walls 28 and 29 are adjacent the third side wall 30. The protrusions 38 engage in the recesses 39 in a snap-fit manner such that the first and second side walls 28 and 29 can be engaged with the third side wall 30 to hold the base wall 12 in the position in which it is perpendicular to the third side wall 30. However, as can be appreciated by one skilled in the art, the protrusions 38 and recesses 39 may connect in any manner that provides a suitable connection.

The storage module 11 of FIGS. 7-12 can also be connected to adjacent bra storage devices 10. In this embodiment, the first connectors 32 comprise a plurality of lugs 36 on the edge of the third side wall 30 remote from the base wall 12. The second connectors 33 comprise corresponding slots 37 in the edge of the third side wall 30 adjacent the base wall 12. The lugs 36 are received in the slots 37 to connect multiple storage modules 11 together.

Figure 11:
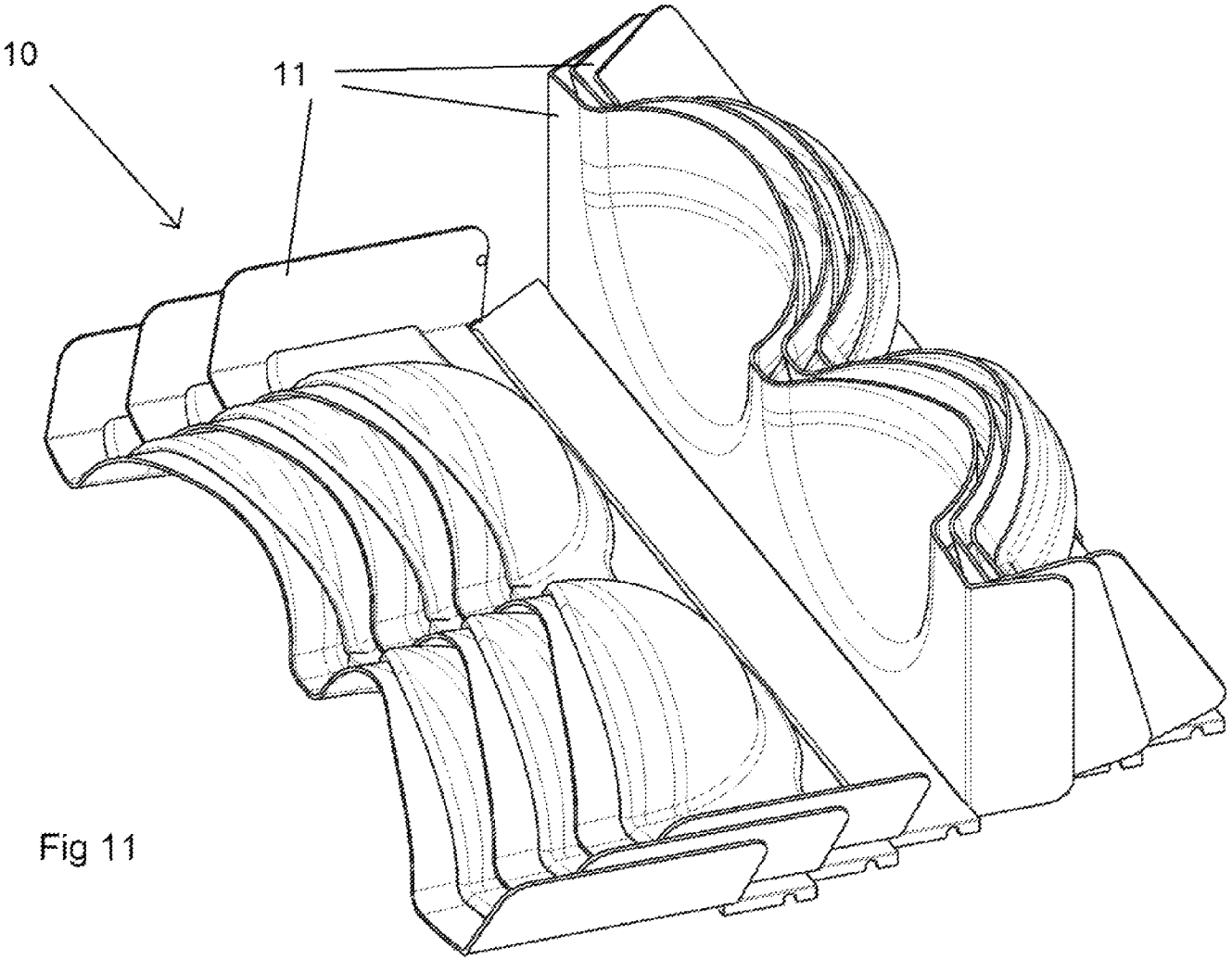
FIG. 11 is a rear, perspective-view illustration of the bra storage device showing some of the base walls pivoted to the vertical position according to principles of the present invention.
Figure 12:
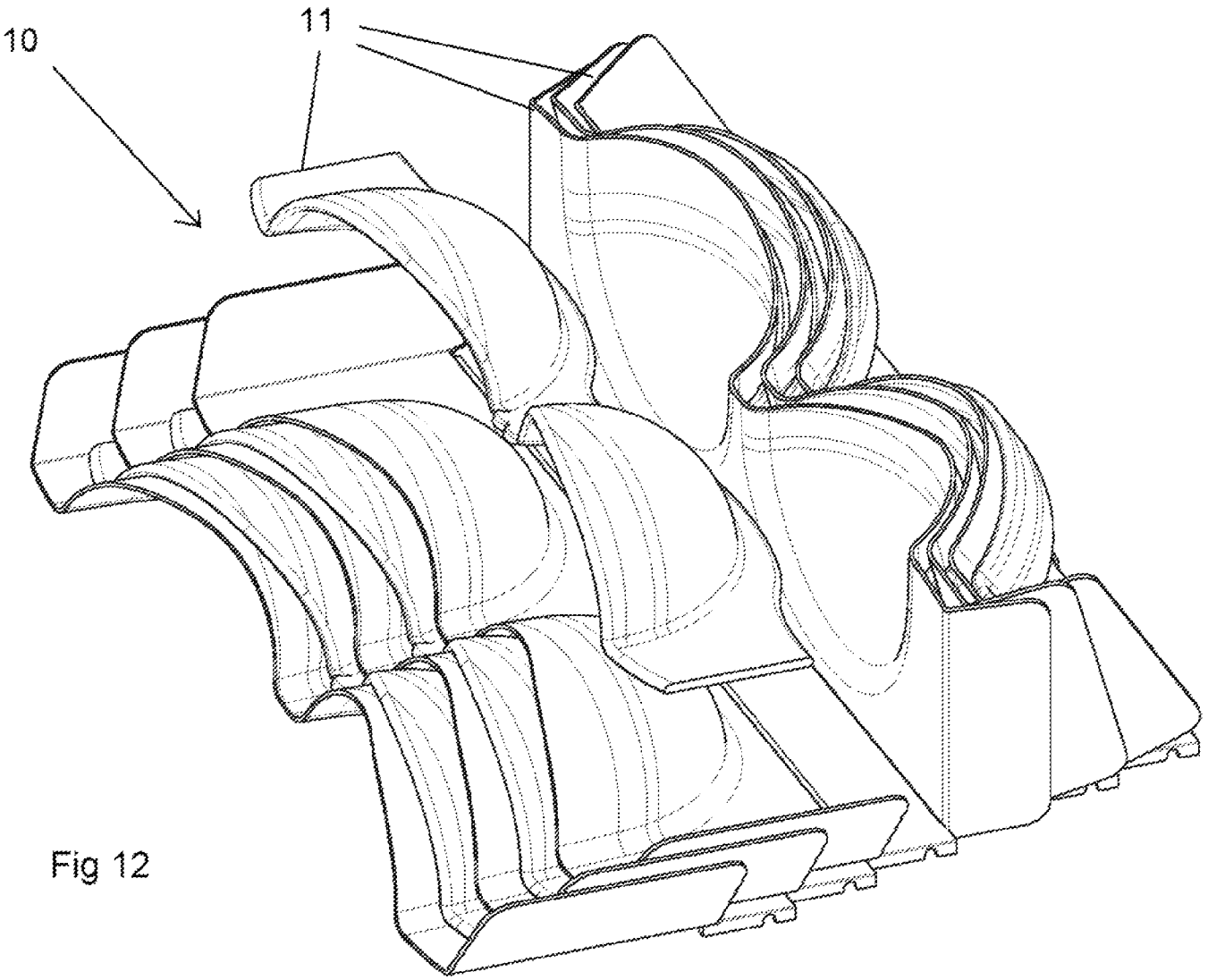
FIG. 12 is a rear, perspective-view illustration of the bra storage device of FIG. 11 showing removal of a bra according to principles of the present invention.

As shown in FIGS. 9-12, the third side walls 30 of all of the connected storage modules 11 join together in a similar manner to the first embodiment. In order to access any particular bra 20, the base wall 12 of the storage module 11 on which that bra 20 is placed, and the base wall 12 of the storage modules 11 behind may be pivoted backwardly (as shown in FIGS. 11 and 12).

FIGS. 13-19 illustrate a third embodiment of bra storage device 10 comprising a base wall 12 and one or more bra support members 14. Each bra support member 14 comprises a pair of domed members 16 joined by an interconnecting portion 18. The domed members 16 are arranged such that the cups of a bra 20 can be placed on the domed members 16. The domed members 16 are shaped to support the cups of the bra 20 to prevent damage to the bra 20.

The bra storage device 10 comprises one or more bra support members 14 supported vertically above the base wall 12. The base wall 12 comprises a planar member having a generally rectangular shape. The base wall 12, therefore, includes first and second parallel sides 22 and 23 and first and second parallel ends 24 and 25. The bra support members 14 are secured above the base wall 12 such that an axis running through the centers of the domed members 16 is parallel to the first and second sides 22 and 23.

Figure 16:
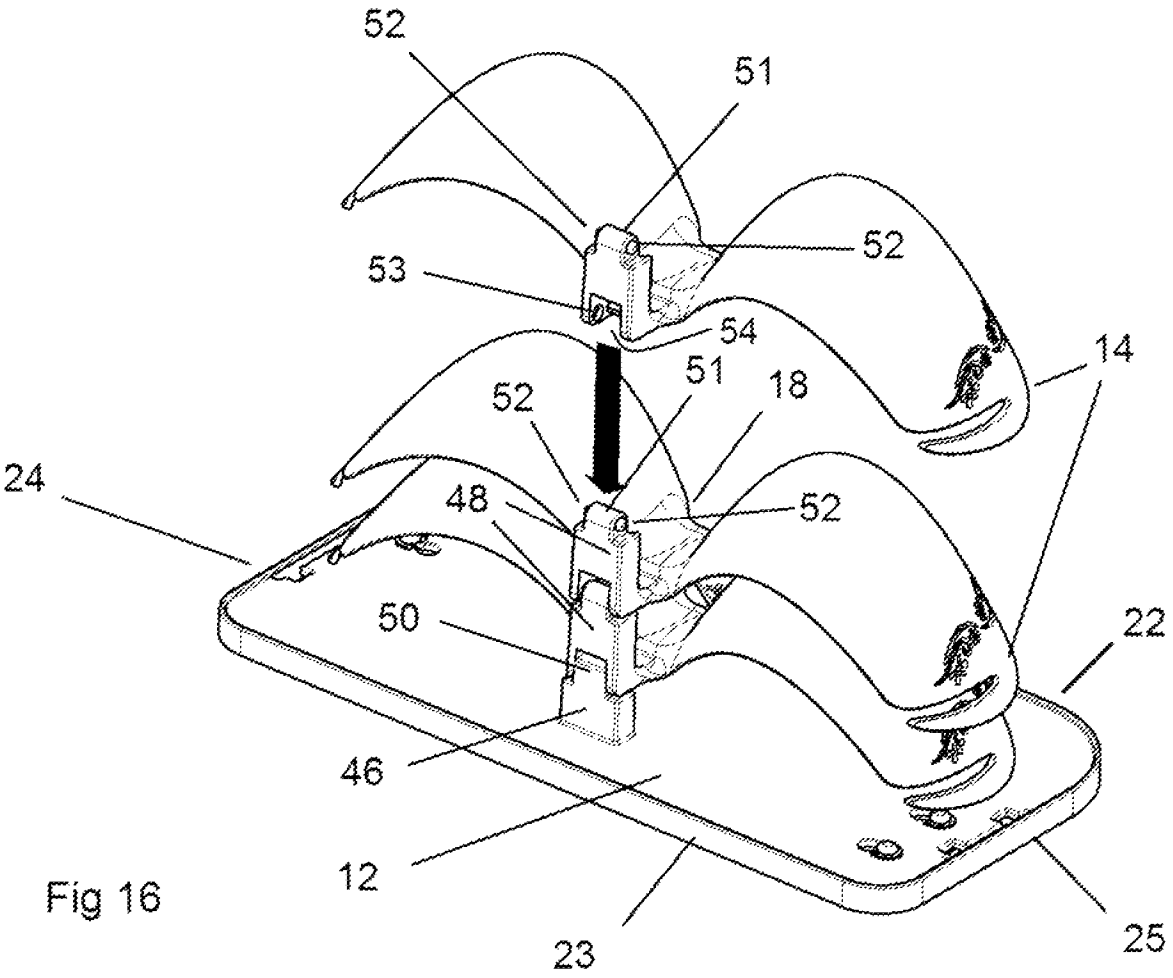
FIG. 16 is a top, perspective-view illustration of the bra storage device of FIG. 13 showing attachment of a bra support member according to principles of the present invention.

The base wall 12 is provided with connector base 46 (as depicted in FIG. 16) for receiving a connecting member 48 provided on a bra support member 14. The connector base 46 is located adjacent the first side 22 of the base wall 12 generally midway between the first and second ends 24 and 25. The connector base 46 includes a protrusion 50 on a distal end thereof. The protrusion 50 includes a pair of lugs 52 on opposite sides thereof. The pair of lugs 52 is rounded and an axis joining the lugs 52 is oriented parallel to the first side 22.

Each bra support member 14 is provided with a connecting member 48 extending outwardly from the interconnecting, portion 18. Each connecting member 48 includes a protrusion 51 at a first end thereof and an opening 54 at a second opposite end thereof. The protrusion 51 is of the same form as the protrusion 50 on the connector base 46 and, therefore, includes a pair of rounded lugs 52. The opening 54 is dimensioned to receive the protrusion 50 of either the connector base 46 or of a connecting member 48 located below.

Opposed inner surfaces of the opening 54 include a pair of recesses 53 to receive the lugs 52 of the connecting member 48 of the bra support member 14 located below in a snap-fit manner (or any other suitable method of connection). A first bra support member 14 can, therefore, be secured above the base wall 12 by fitting the protrusion 50 of the connector base 46 into the opening 54 of the first bra support member 14. Further bra support members 14 can then be connected to the lower bra support members 14 by receiving the protrusion 51 of the lower bra support member 14 into the opening 54 of the connecting member 48 of the further bra support member 14.

Figure 13:
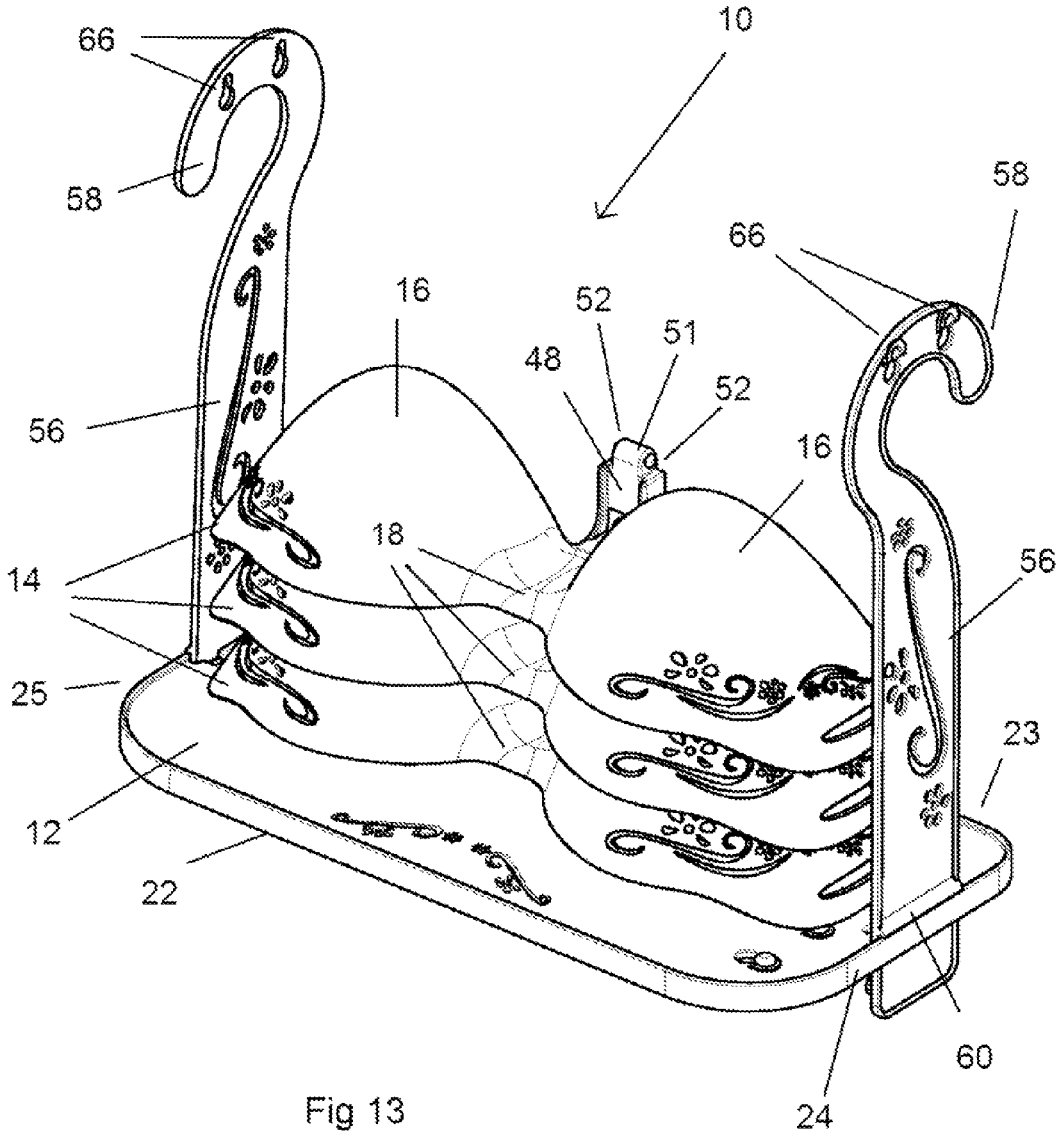
FIG. 13 is a top, perspective-view illustration of an embodiment of a bra storage device according to principles of the present invention.
Figure 14B:
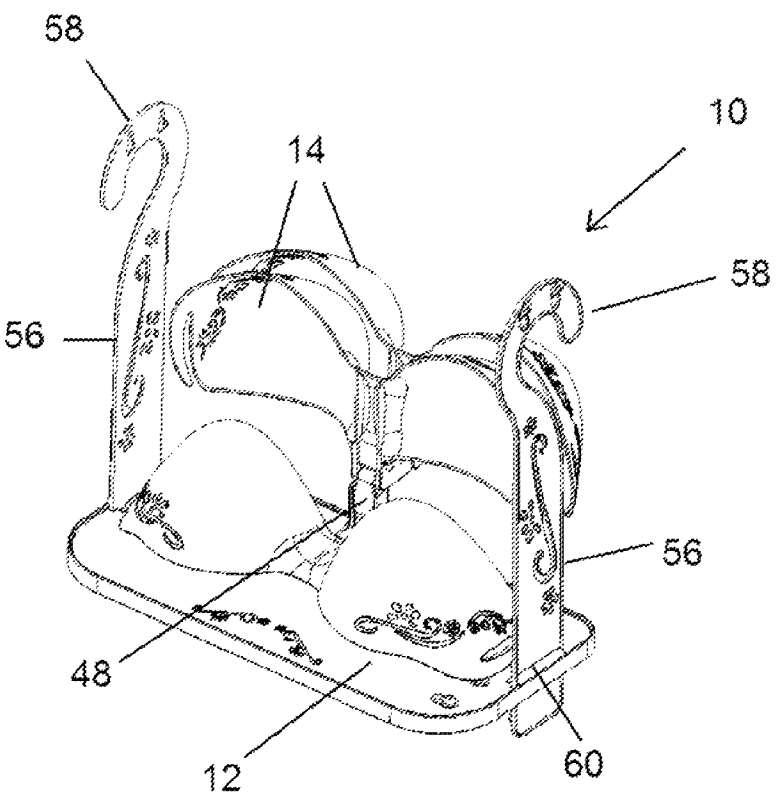
FIG. 14*b* is a top, perspective-view illustration of the bra storage device of FIG. 13 with the two uppermost bra support members pivoted to the second position according to principles of the present invention.
Figure 14A:
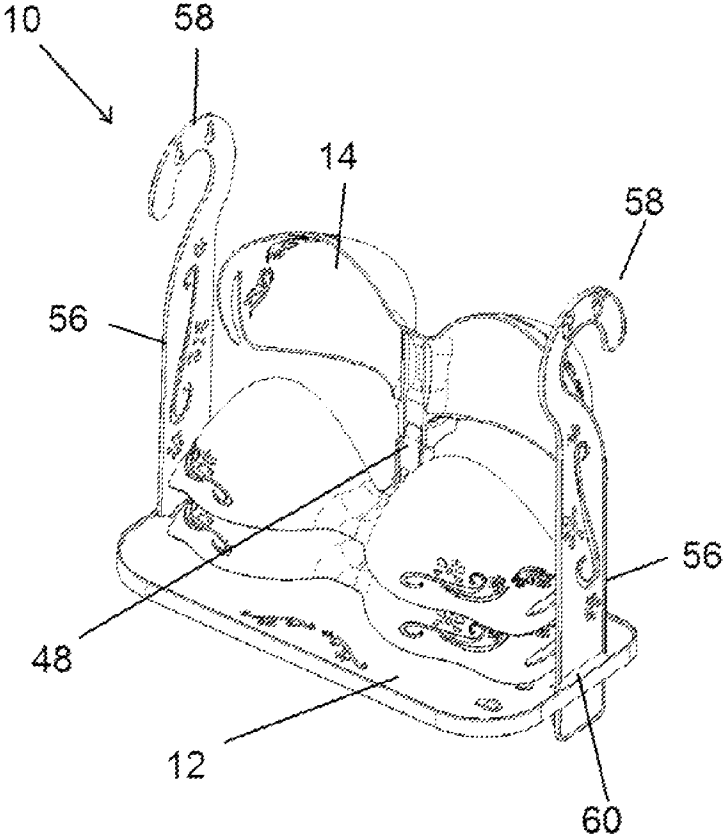
FIG. 14*a* is a top, perspective-view illustration of the bra storage device of FIG. 13 with the uppermost bra support member pivoted to a second position according to principles of the present invention.

Each connecting, member 48 can pivot relative to the connecting member 48 or connector base 46 below between a first position (as shown in FIG. 13) and a second position (as shown in FIG. 14). Either the uppermost or a plurality of uppermost bra support members 14 can, therefore, be pivoted between the first and second positions.

In the first position, the bra support member 14 is oriented above and generally parallel to the base wall 12. In the second position, the bra support member 14 is pivoted through approximately 90 degrees, such that the bra support member 14 is generally perpendicular to the base wall 12.

The domed members 16 of the bra support members 14 each include a recessed lower side. When a plurality of bra support members 14 is arranged above each other, the domed members 16 of each bra support member 14 are received in the recessed lower sides of the bra support members 14 above, as shown in FIG. 13.

In use, a number of bra support members 14 can be secured above the base wall 12. A bra 20 can then be placed on each bra support member 14 such that the cups are received in the domed members 16 of the bra support member 14. By pivoting one or more of the uppermost bra support members 14 from the first position to the second position, any bra 20 can be accessed for viewing and removal from the bra support member 14 for use. The arrangement, therefore, allows a number of bras 20 to be stored in a relatively small space with easy access to any stored bra for wearing.

Figure 19:
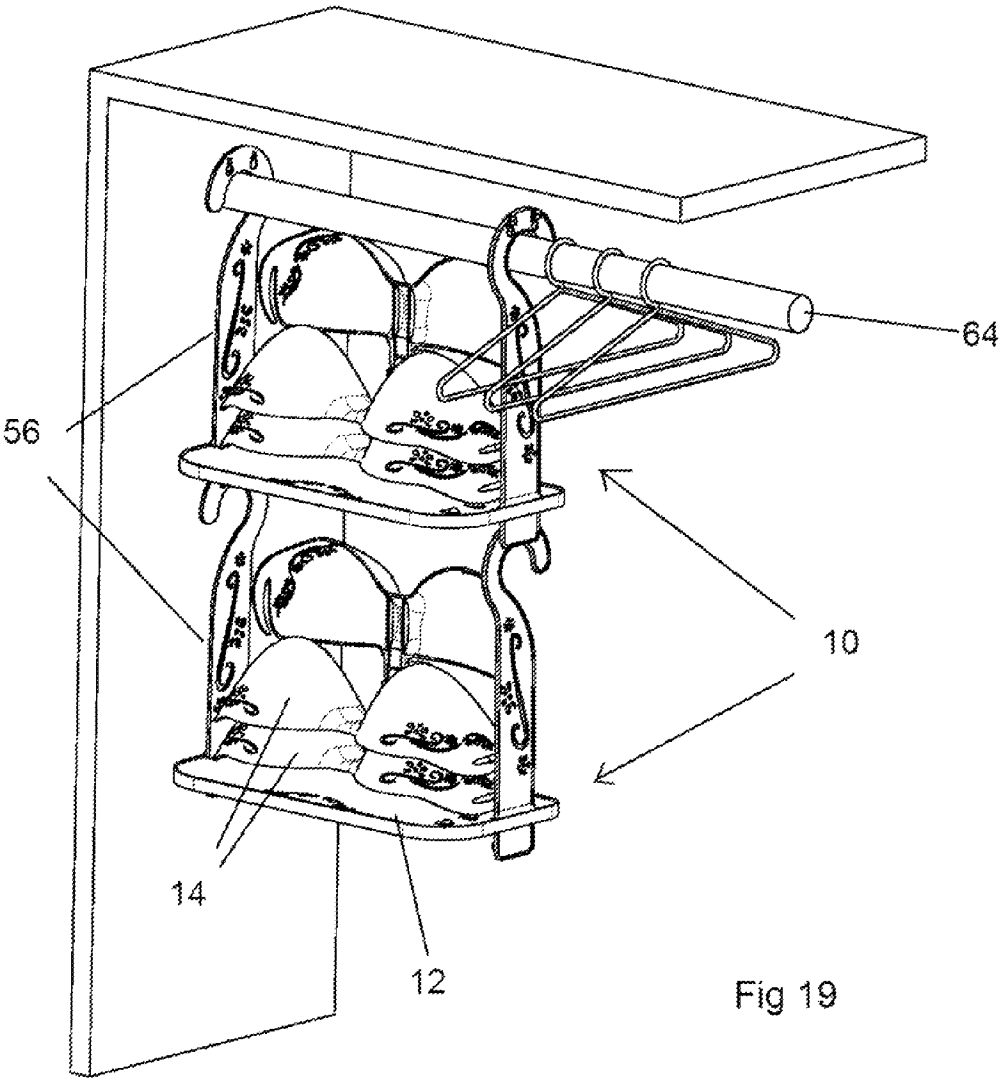
FIG. 19 is a perspective-view of a pair of bra storage devices stored vertically from a hanging rail according to principles of the present invention.

The bra storage device 10 is also provided with a pair of anus 56. Each arm 56 comprises a planar elongate member having a hook 58 at a first end thereof. A pair of slots 60 is provided in the base wall 12, one adjacent each of the first and second ends 24 and 25. The arms 56 are each received in a respective slot 60 such that the arms 56 extend perpendicular to the base wall 12. The hooks 58 can be engaged with a hanging rail 64 (as shown in FIG. 19) so that the bra storage device 10 can be stored inside a cupboard.

Each arm is provided with holes 66 adjacent the first end thereof and lugs 68 adjacent the second end thereof. In the embodiment shown, there is provided a pair of holes 66 having a keyhole shape and a pair of lugs 68 having widened distal ends. The lugs 68 of each arm 56 can be engaged with the holes 66 of an arm of a further bra storage device 10 located below. As shown in FIG. 19, multiple bra storage devices 10 can, therefore, be connected vertically to store a larger number of bras 20.

Figure 15:
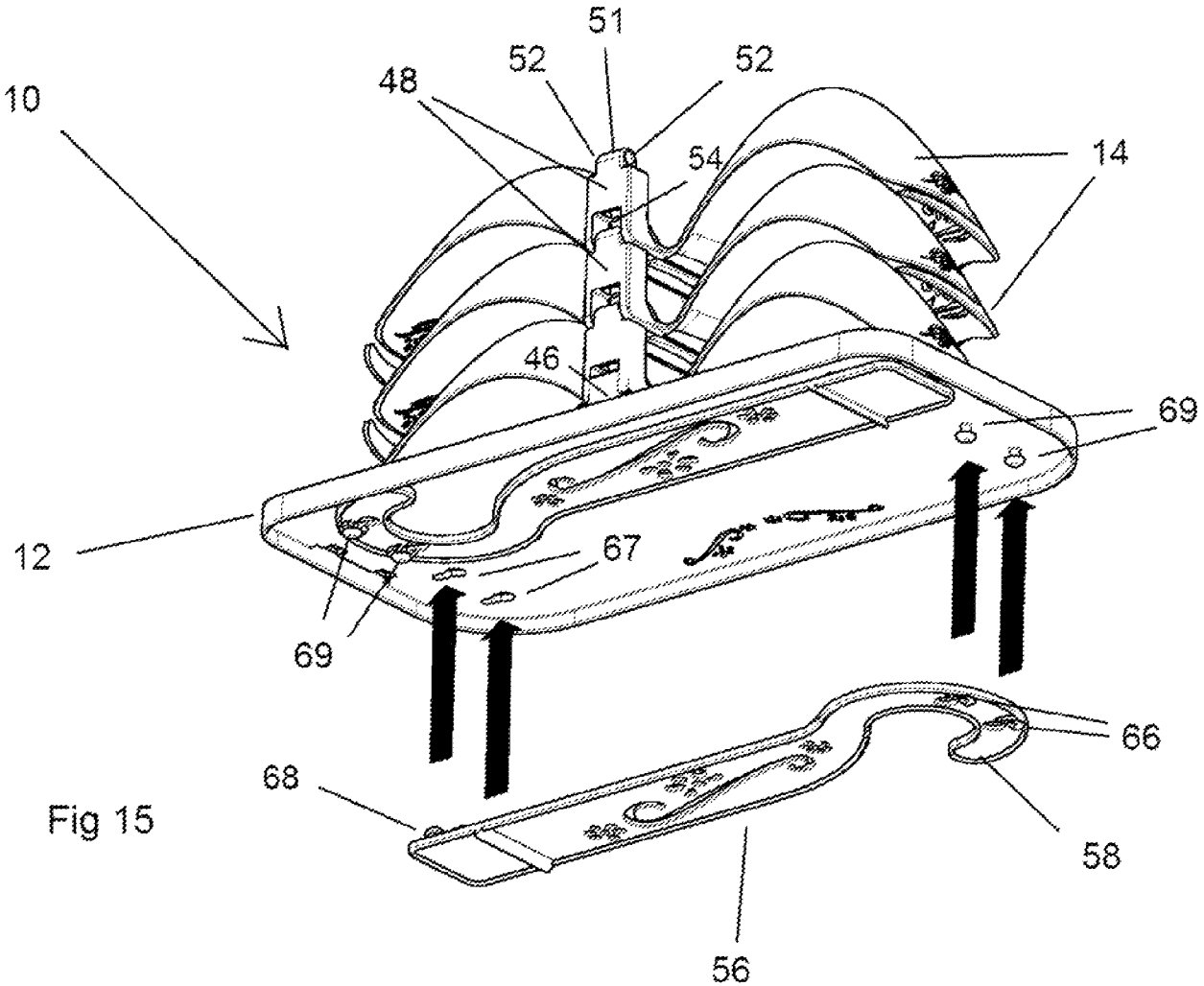
FIG. 15 is a bottom, perspective-view illustration of the bra support member of FIG. 13 showing connection of the arms to the lower side of the base wall according to principles of the present invention.
Figure 17:
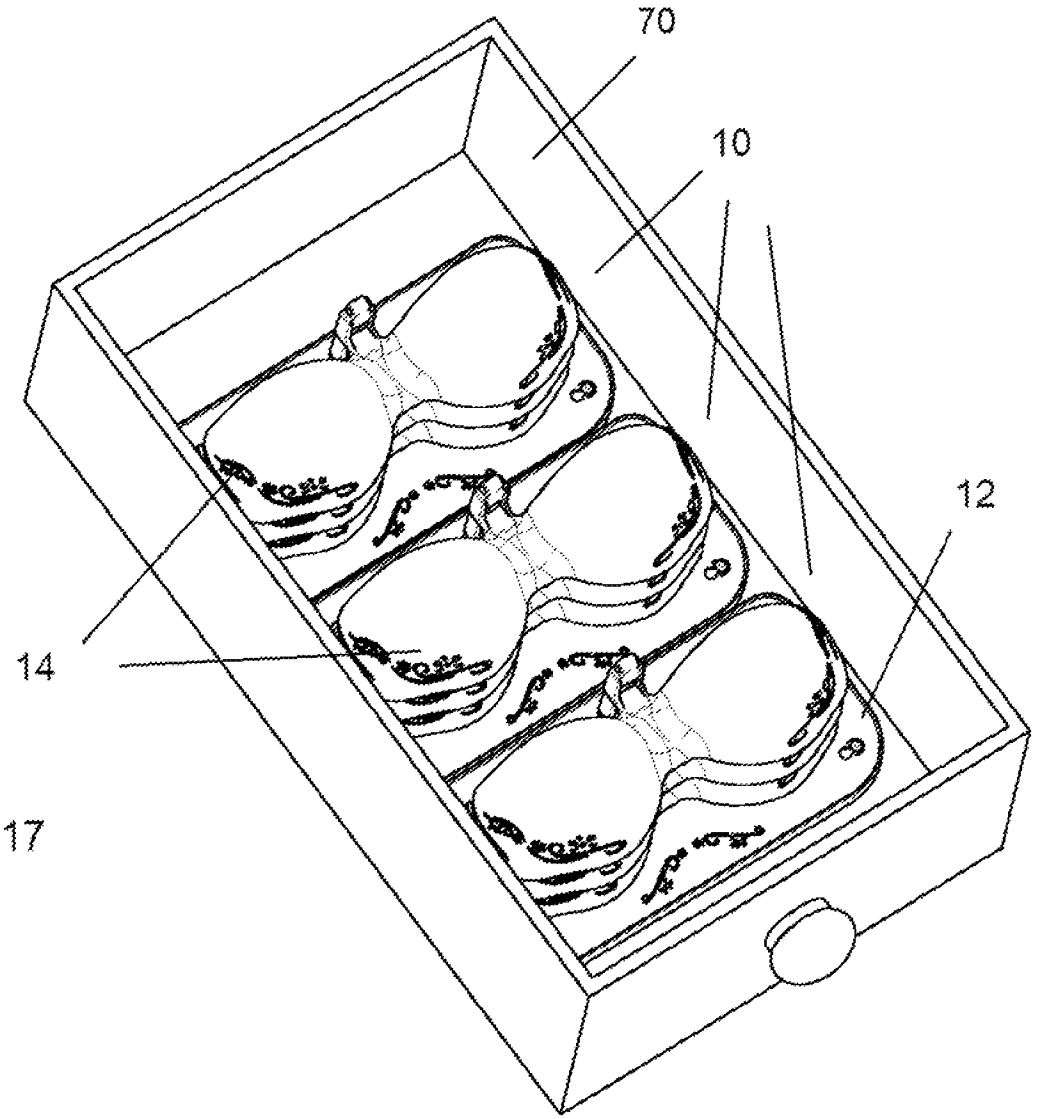
FIG. 17 is a perspective-view illustration of a plurality of bra storage devices stored within a drawer according to principles of the present invention.
Figure 18:
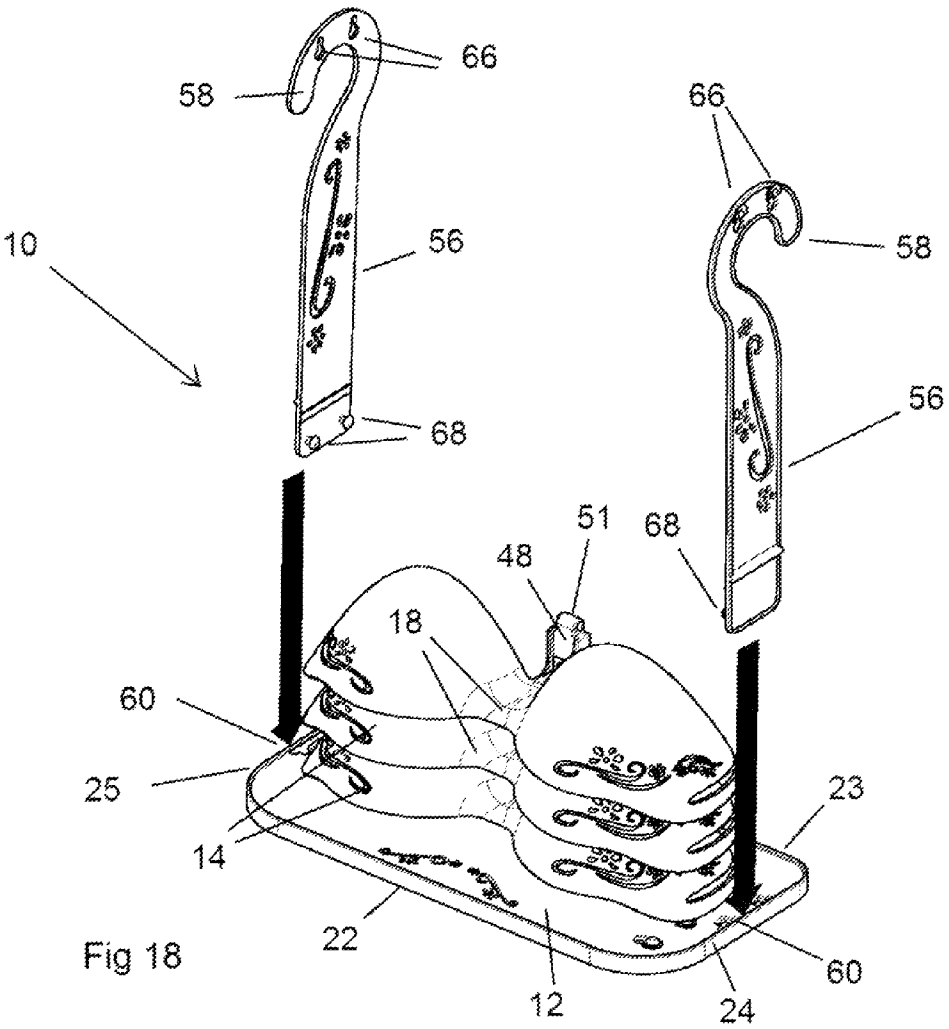
FIG. 18 is a top, perspective-view illustration of the bra storage device of FIG. 13 showing attachment of arms to the base wall according to principles of the present invention.

The arms 56 may also be detached from the base wall 12 so that the bra storage device 10 may be stored on a horizontal surface such as inside a drawer. As shown in FIG. 17, multiple bra storage devices 10 may be stored side-by-side in a drawer 70. The base wall 12 is also provided with lugs 69 and holes 67 adjacent the first and second ends 24 and 25. The lugs 69 and holes 67 are arranged such that each of the arms 56 can be connected to a lower side of the base wall 12 by receiving the lugs 68 on the arms 56 in the holes 67 on the base wall 12 and the logs 69 on the base wall 12 in the holes 66 on the arms 36 (as shown in FIG. 15).

It will be readily apparent to persons skilled in the relevant arts that various modifications and improvements may be made to the foregoing embodiments, in addition to those already described, without departing from the bask inventive concepts of the present invention.

What is claimed is:

1. A bra storage device comprising a plurality of storage modules, each storage module comprising:

a base wall provided with a bra support member onto which the cups of a bra can be placed;

at least one side wall extending from the base wall, wherein the at least one side wall has edges remote from the base wall and adjacent the base wall;

at least one first connector provided on edges of the side walls remote from the base wall; and at least one second connector provided on edges of the side walls adjacent the base wall;

wherein the first connectors of the storage module are connectable to the second connectors of an adjacent storage module.

2. The bra storage device as set forth in claim 1, wherein the base wall comprises a planar member, and each bra support member comprises a pair of domed members extending outwardly from the base wall.

3. The bra storage device as set forth in claim 2, wherein the pair of domed members are integrally formed with the base wall such that each domed member comprises a domed portion of the base wall extending outwardly therefrom.

4. The bra storage device as set forth in claim 1, wherein the base wall is rectangular and comprises first and second parallel sides and first and second parallel ends, and the at least one side wall comprises first and second side walls extending transversely from the first and second ends of the base wall and a third side wall extending transversely from the first side of the base wall between the first and second end walls.

5. The bra storage device as set forth in claim 4, wherein the storage modules are connectable such that the third side wall of each storage module is coplanar, and the base wall of each storage module is parallel to the base wall of an adjacent storage module, such that a compartment is defined between the base wall, the side walls, and the base wall of the adjacent storage module into which a bra may be placed.

6. The bra storage device as set forth in claim 4, wherein the first connectors comprise ribs extending along the edges of the first and second side walls, and the second connectors comprise channels extending along opposite edges of the first and second side walls, such that the ribs of a storage module are receivable in the channels of an adjacent storage module.

7. The bra storage device as set forth in claim 4, wherein the first connectors comprise a plurality of lugs on the edge of the third side wall remote from the base wall, and the second connectors comprise corresponding slots in the edge of the third side wall adjacent the base wall, such that the lugs are received in the slots to connect multiple storage modules together.

8. The bra storage device as set forth in claim 7, wherein the third side wall is pivotally connected to the base wall, such that the base wall can be pivoted between a position in which the base wall is parallel to the side wall and a position in which the base wall is generally perpendicular to the side wall.

9. The bra storage device as set forth in claim 8, wherein the first and second side walls comprise protrusions provided to engage in recesses in edges of the third side wall when the base wall is pivoted such that the first and second side walls are adjacent the third side wall.

10. The bra storage device as set forth in claim 9, wherein protrusions engage in the recesses in a snap-fit manner.

* * * * *